US005488831A

United States Patent [19]

Griswold

[11] Patent Number: 5,488,831

[45] Date of Patent: Feb. 6, 1996

[54] LIQUID CRYOGEN WITHDRAWAL DEVICE

[76] Inventor: Thomas A. Griswold, 136 Jobs Hill Rd., Ellington, Conn. 06029

[21] Appl. No.: 319,367

[22] Filed: Oct. 6, 1994

[51] Int. Cl.[6] ..... F17C 7/04

[52] U.S. Cl. ..... 62/48.1; 62/50.2

[58] Field of Search ..... 62/48.1, 50.1, 62/50.2

[56] References Cited

U.S. PATENT DOCUMENTS

| | | | |
|---|---|---|---|
| 3,750,414 | 8/1973 | Heftman | 62/50.1 |
| 4,091,634 | 5/1978 | Shepherd | 62/48.1 |
| 4,279,626 | 7/1981 | Buchmuller et al. | 62/50.1 |
| 4,299,091 | 11/1981 | Carter et al. | 62/48.1 |
| 4,313,306 | 2/1982 | Torre | 62/48.1 |
| 4,608,831 | 9/1986 | Gustafson | 62/48.2 |

FOREIGN PATENT DOCUMENTS

| | | |
|---|---|---|
| 0255797 | 2/1990 | Japan . |
| 0914219 | 12/1962 | United Kingdom . |
| 1441251 | 6/1976 | United Kingdom . |

*Primary Examiner*—Ronald C. Capossela
*Attorney, Agent, or Firm*—M. P. Williams

[57] ABSTRACT

A liquid cryogen withdrawal device includes a plug (14) for insertion into the neck of a cryogen-containing dewar (10) in gas-tight relationship. A withdrawal tube (17) passes through the plug to conduct liquid from the bottom of the dewar through a sintered bronze filter to a container to be filled with cryogen. Cryogen is stored in the dewar with a loose fitting cap thereon, with no withdrawal device in the dewar. When liquid is desired to be retrieved from the dewar, the withdrawal device is inserted into the dewar; the withdrawal device has a passive heat source (18) disposed at the bottom thereof to cause sufficient boiling of the liquid to create enough pressure to force a suitable amount of liquid from the dewar. The plug may have a handle and a gas pressure relief valve disposed thereon.

14 Claims, 2 Drawing Sheets

LIQUID CRYOGEN WITHDRAWAL DEVICE

TECHNICAL FIELD

This invention relates to a device for withdrawing liquified cryogenic gas, such as nitrogen, from a dewar, and related method, which essentially doubles the static holding time for cryogenic liquid stored in a dewar.

BACKGROUND ART

As an example for understanding the present invention, liquified nitrogen, $LN_2$, is typical of cryogens, and is widely used in industry and in health care. In many applications, liquid nitrogen is stored in various sized dewars near the point of use, and smaller amounts are withdrawn from the dewar to be utilized in an apparatus or instrument as needed. An example of use in health care is set forth in U.S. Pat. No. 4,116,199. Examples of the use of small amounts of nitrogen in industry are given in U.S. Pat. No. 5,222,999 and U.S. Pat. No. 5,237,836. In these examples, nitrogen may be stored near an industrial work station or within a doctor's office or other treatment facility in a dewar ranging from 5 liters to 50 liters, depending upon the particular application involved. In use, the nitrogen is withdrawn from the storage dewar and placed in the container of a utilization device, such as the examples referred to hereinbefore.

Currently, the liquid cryogen is withdrawn from a storage dewar by means of what is known in the art as a withdrawal device. This constitutes a plug which fits into the top of the dewar in place of the storage plug, and is held tightly in place by means of expansion, or by means of hold-down devices, such as springs, straps or clamps. Within the plug there is provided a common pressure relief valve, which typically is set to maintain the gas pressure in the dewar no greater than about 4 pounds per square inch. The device has a long tube which extends downwardly through the plug to the bottom of the dewar. It extends outwardly of the plug and turns to become horizontal, where a gas-tight valve is fitted. Outwardly of the valve, the tube may be bent downwardly somewhat to direct the liquid toward a container to be held near the dewar, and the liquid flows out of the tube through a sintered bronze filter, which softens the flow (much like the aerator on a kitchen faucet). When liquid cryogen is to be withdrawn, the valve is opened; when the container (e.g., of the utilization device) is full, the valve is closed once again. The withdrawal unit remains attached to the dewar, immersed in the cryogen, at all times except when the dewar is being refilled.

The principal problem with such a withdrawal device is that the presence of the tube within the liquid inside the storage dewar continuously pumps heat from the atmosphere outside into the liquid, causing it to continuously boil, converting the liquid to gas, which escapes through the pressure valve. A typical rate of evaporation is over twelve grams per hour (816 grams per liter). A typical 10 liter dewar with a withdrawal device known in the art mounted therein has a static holding time (that is, the time when all 10 liters of cryogen will evaporate simply by sitting in the storage dewar, with no liquid being removed) of approximately 27 days. This means, in use, various amounts of the liquid is wasted, depending upon how much is actually used. While nitrogen is extremely inexpensive (compared to other industrial substances and medical modalities), the delivery of a small amount to a doctor's office, or the like, can be unnecessarily expensive, due to the evaporation caused by the withdrawal device.

Another, less significant problem is that should an operator become distracted, such as dropping a device being filled, or otherwise, a withdrawal device known to the prior art can rapidly empty an entire storage dewar so long as the valve is left open.

DISCLOSURE OF INVENTION

Objects of the invention include provision of a withdrawal device for liquid cryogen storage dewars and a method of use which minimizes the wasteful evaporation of the liquified cryogen, and a liquid cryogen withdrawal device which is safer to use than those known to the art.

According to the present invention, a device for withdrawing liquid cryogen from a cryogen storage dewar comprises an open tube, which may be fitted with the sintered bronze filter at a distal, outflow end thereof, and having a passive heat source disposed at a proximal, inflow end thereof, the tube being disposed through a plug that will fit in gas-tight relationship within the neck of a storage dewar. There is no need for a valve on the device of the present invention. In use, the liquid cryogen is stored in the dewar with its normal, loose fitting cap that allows the gas to escape around the loose fitting cap. The liquid lies quiescently, with a minimum of boiling and gas loss. When it is desired to withdraw liquid cryogen from the storage dewar, the withdrawal device of the present invention is inserted into the neck of the dewar in gas-tight relationship, the passive heat source transfers sufficient heat into the liquid cryogen so as to initially cause sufficient boiling to pressurize the dewar, thereby forcing liquid upwardly through the tube and the sintered bronze filter, where it can be captured in the utilizing device or other container. The passive heat source typically comprises a metal having a high heat capacity, such as brass, which may surround the base of the tubing. By regulating the amount of material in the passive heat source, a limited amount of control can be exercised over the flow of liquid. An insulated handle may be provided.

The withdrawal device of the present invention will literally double the static holding time of liquid cryogen, such as nitrogen, reducing the evaporation to less than six grams per hour. Thus, use of the invention can increase the time for natural evaporation of a full dewar, such as 10 liters, to about 60 days. The invention also regulates the total flow from the device, since exhaustion of the heat provided by the tubing and the passive heat source results in the exhaustion of pressure, and a reduction of flow of liquid to a negligible amount (essentially zero).

Other objects, features and advantages of the present invention will become more apparent in the light of the following detailed description of exemplary embodiments thereof, as illustrated in the accompanying drawing.

BEST MODE FOR CARRYING OUT THE INVENTION

Figure 1:
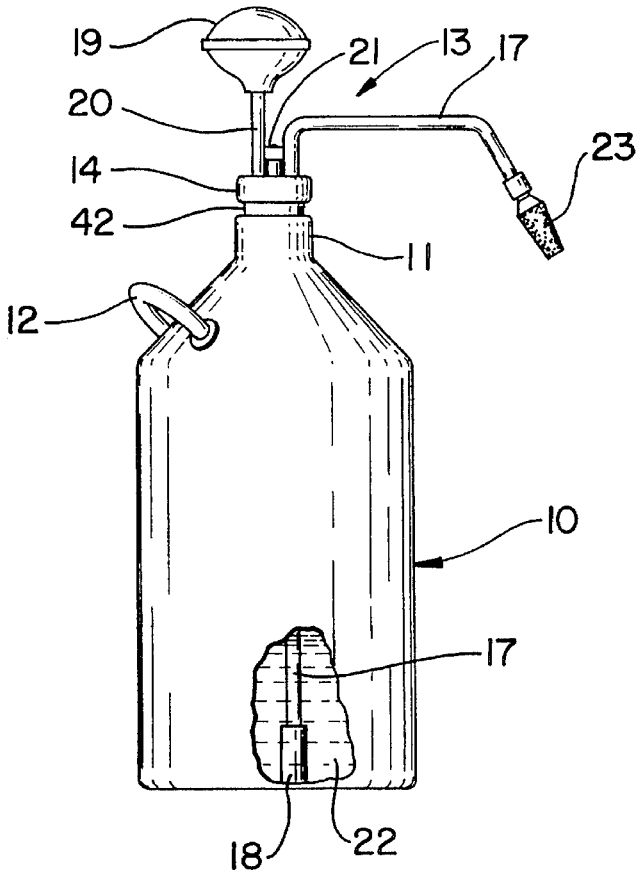
FIG. 1 is a simplified side elevation view of a dewar fitted with a withdrawal device according to the present invention.

In FIG. 1, a dewar 10 typically comprises two aluminum (or stainless steel) containers, one disposed within the other, joined at a neck section 11, with the space therebetween evacuated so as to provide superior insulation. The dewar 10 may be provided with one or more handles 12. A withdrawal device 13 of the present invention includes a plug 14 which fits in gas-tight relationship within the opening of the neck 11. A withdrawal tube 17 extends through the plug 14 to the bottom of the interior of the dewar so as to convey liquid 22 from the dewar through a sintered bronze filter 23 and into any container which is held beneath the filter 23, such as a utilization device of the type described hereinbefore. Surrounding the bottom, proximal end of the withdrawal tube 17 is a passive heat source 18 which, in this example, comprises a hollow cylinder of brass. The plug 14 has a handle 19 secured thereto by a shaft 20. The pressure in the dewar 10 is limited by virtue of a gas pressure relief valve 21 disposed on the plug 14 and in communication with the interior of the dewar 10.

When liquified cryogen is being stored within the dewar 10, in accordance with the invention, the withdrawal device 13 is not installed in the dewar as shown in FIG. 1. Instead, a loosely fitting cap (not shown), which is common in the art, similar to the plug 14, provides insulation but allows gas to freely escape. Thus, there is no heat conducted into the liquid 22 within the dewar, so the liquid boils much less than it would with withdrawal devices known to the prior art installed in the dewar 10. Therefore, the static holding time is approximately doubled.

When withdrawal of liquid from the dewar 10 is desired, the loose cap (not shown hereinbefore) is removed from the dewar 10, and the withdrawal device 13 is inserted therein, being pressed down a little with the handle 19, so as to from a gas-tight fit at the neck 11. The liquid 22 in the dewar contacts the passive heat source 18 and withdraws heat therefrom, causing the liquid 22 to boil, creating pressure within the device. This forces liquid up through the withdrawal tube 17 and out through the sintered bronze filter 18 into whatever container is placed in proximity therewith. Because the amount of heat within a passive heat source 18 is limited, after a short period of time all the heat is removed from the passive heat source 18 and the withdrawal tube 17, so that boiling of the liquid 22 essentially ceases, and the flow of liquid in the withdrawal tube 17 slows to a trickle, and essentially stops.

The extent of flow of liquid from the dewar 10 can be controlled somewhat by the amount (the weight) of material in the passive heat source 18. Some rough exemplary tests were performed utilizing a 30 liter dewar. Then, the amount of liquid which was delivered from the dewar with a substantial flow, prior to the flow reducing to a trickle, was measured. In each instance, the material of the passive heat source 18 was brass, fitted on a 304 stainless steel withdrawal tube 17 having a ⅜ inch OD with a 20 mil wall. Use of a 30 gram heat source 18 delivered ½ liter liquid through the sintered bronze filter 18 before the flow began to trickle off; 55 grams delivered one liter; and 125 grams delivered 2½ liters before the flow reduced to a trickle. When the same dewar was essentially full of liquid nitrogen, 30 grams resulted in one liter of liquid, 55 grams yielded 1¾ liter of liquid and 125 grams yielded the same 2½ liters as before. This aspect of the invention is useful, in applications of use with a utilization device such as a cryosurgical unit of the first patent hereinbefore, where approximately one liter of nitrogen is desired, and the limited rate of usage is such that static holding time becomes important.

Figure 2:
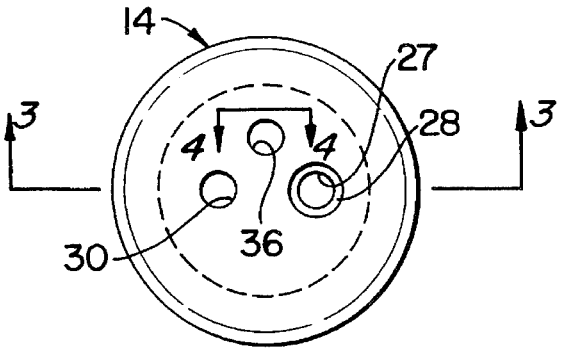
FIG. 2 is a top plan view of a plug which forms the basic structure of the withdrawal device of FIG. 1.
Figures 3, 4:
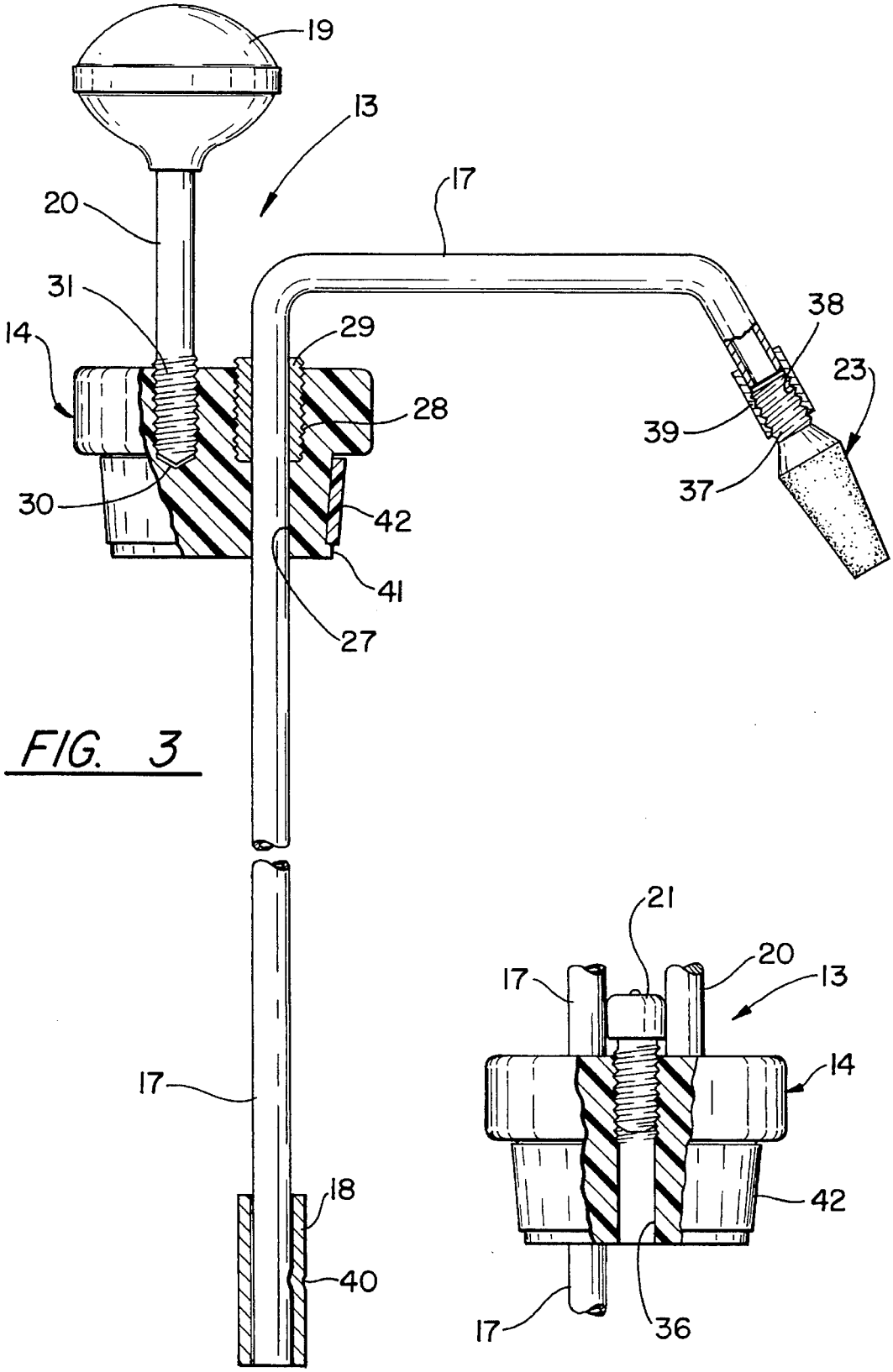
FIG. 3 is a partial, partially broken away, front elevation view, partially sectioned on the line 3—3 of FIG. 2.
FIG. 4 is a partial, rear elevation view of the plug, partially sectioned on the line 4—4 of FIG. 2.

Referring now to FIG. 2, the plug 14 is provided with a hole 27 having threads 28 therein. As seen in FIG. 3, the hole 27 passes entirely through the plug. The withdrawal tube 17 has a threaded bushing 29 disposed thereon on any suitable way; for instance, the threaded bushing 29 may be formed of brass and it may be silver soldered to the withdrawal tube 17. The threaded bushing 29 engages the teeth 28, and forms a gas seal between the plug 14 and the withdrawal tube 17. Another threaded hole 30 receives the shaft 20 which has threads 31 on the lower end and additional threads (not shown) on its upper end. The hole 30 is a blind hole, thereby providing no path for gas to escape. The threads on the upper end of the shaft 20 engage like threads within the handle 19, which may comprise a common implement handle, such as the type used on snowplow controls. The handle 19 may be made of plastic or any other suitable material that provides some measure of insulation and allows the operator to insert and remove the withdrawal unit 13.

In FIG. 2, a third hole 36 is threaded to receive the gas pressure relief valve 21, which may be any ordinary pressure relief valve having a suitable pressure rating, a number of which are readily available in the market. The pressure rating may be on the order of 2 psi or 4 psi when used with this invention. Its purpose is simply for safety, so as to avoid excess pressure buildup if for some reason the passageway through the withdrawal tube 17 and sintered bronze filter 23 became blocked.

In FIG. 3, the sintered bronze filter 23 is of a type well known in the art and readily available in the marketplace. It includes threads 37 which engage interior threads 38 of an adapter 39 which is disposed on the distal end of the withdrawal tube 17, in any suitable way, such as by being silver soldered on the end of the tube 17.

In FIG. 3, the passive heat source 18 may simply comprise a brass cylinder which is secured to the withdrawal tube 17 in any fashion that will simply prevent it from falling into the dewar. In the example herein, the passive heat source 18 is staked to the withdrawal tube 17 by a crimp 40.

The plug 14 may preferably be formed of delrin. The plug 14 has a peripheral lip formed therein which retains a gasket 42 which assists in making a gas-tight seal between the plug 14 and the interior of the neck 11 of the dewar 10. The gasket 42 may simply comprise a length of industrial silicone tubing, which is stretch fit over the lip 41 and which deforms into a frustoconical shape, as shown (in the nature of a cork). The silicone tubing is somewhat soft, and therefore may show wear and require replacement, but it has excellent low temperature properties, and will not become brittle.

In the foregoing example, the passive heat source 18 is a brass cylinder staked to the outside of a thin wall stainless steel withdrawal tube 17. However, it should be understood that instead of staking the cylinder 18 to the tube 17, the cylinder 18 could be silver soldered to the end of the tube (allowing the tube to be somewhat shorter than it is shown in FIG. 3). That is, the stainless steel tubing need not extend all the way through the brass cylinder 18. Thus, the heat source can double as tubing. In a similar fashion, the principle of the present invention, instant pressurizing when needed, rather than maintaining constant slow pressurization as in the prior art, can be practiced by allowing the passive heat source to actually comprise more of the flow path in place of the tubing 17, and in fact can comprise all of it. However, having the source of heat concentrated near the bottom of the dewar, when the withdrawal device is installed therein, facilitates providing of heat to the liquid to cause it to boil, even when the liquid level is low. Having the entire tube simply made of brass would result in having a very rapid and extensive pressure buildup when the dewar was filled, but a very slight buildup when the dewar was empty.

And this is opposite to what is desired, since it is necessary to create a liquid-pumping pressure in a greater volume of gas when the dewar is nearly empty and only a small volume of gas when the dewar is nearly full. Therefore, use of a distributed passive heat source (the whole length of the withdrawal tube) provides a result which is opposite to that desired. Thus, although conducting the liquid from the dewar can be combined with supplying heat to the dewar, it is preferred that the passive heat source have its mass concentrated near the end of the withdrawal tube so as to provide adequate pressurization even when the dewar is nearly empty. Although the heat source is described as being separate herein, it should be understood that the withdrawal tube may include the passive heat source and/or the passive heat source may include the withdrawal tube, so long as both functions are performed. The typical thin wall stainless steel withdrawal tube known to the art, and the one described hereinbefore, will not provide sufficient heat to create enough pressure for any significant flow through a sintered brass filter, but only enough to spurt a small amount of liquid cryogen through an open ended withdrawal tube. Thus a withdrawal tube which is not specifically designed to create sufficient heat to pressurize the dewar enough to cause a flow of at least a quarter liter nitrogen through a sintered bronze filter is not deemed to be a passive heat source within the context of this invention. The passive heat source need not be hollow, nor a cylinder. Any shape of brass or other suitable material may be used.

Thus, although the invention has been shown and described with respect to exemplary embodiments thereof, it should be understood by those skilled in the art that the foregoing and various other changes, omissions and additions may be made therein and thereto, without departing from the spirit and scope of the invention.

I claim:

1. A device for withdrawing liquid cryogen from a dewar, such as for transferring liquid cryogen from the dewar to a container, consisting essentially of:

a plug sized to provide a tight fit within the neck opening of a liquid cryogen dewar;

a withdrawal tube passing through said plug and secured thereto with a gas-tight fit, said tube being of a length to reach substantially the bottom of a dewar with which said withdrawal device is to be used so as to receive liquid at a proximal end thereof, said tube extending outwardly from said plug so as to permit liquid to flow from a distal end thereof into said container; and a passive heat source disposed near the proximal end of said withdrawal tube.

2. A withdrawal device according to claim 1 including a gas pressure relief valve disposed in a hole through said plug so as to be in gaseous communication with the interior of said dewar when said withdrawal device is in use.

3. A withdrawal device according to claim 1 including a handle disposed on said plug to facilitate insertion of said withdrawal device into a dewar and removal of said withdrawal device from said dewar.

4. A withdrawal device according to claim 3 wherein said handle is formed of heat-insulating material.

5. A withdrawal device according to claim 1 including a sintered bronze filter disposed at the distal end of said withdrawal tube.

6. A method of storing liquid nitrogen in a dewar and removing liquid cryogen from said dewar, comprising:

storing liquid cryogen in said dewar with a loose fitting cap inserted in the neck opening of said dewar and with no part of any fixture immersed in said liquid cryogen;

removing said loose fitting cap from the neck opening of said dewar and inserting in said neck opening a liquid cryogen withdrawal device having a plug seated within said neck opening, a withdrawal tube extending through said plug to substantially the bottom of said dewar so as to receive liquid cryogen at its proximal end, and a passive heat source disposed near said proximal end of said withdrawal tube for imparting heat to the liquid cryogen within said dewar, whereby the cryogen in said dewar boils, causing gas pressure to build up thereby forcing liquid into the proximal end of said withdrawal tube, and conducting said liquid from said dewar;

removing said withdrawal device from said neck opening; and restoring said loose fitting cap into said neck opening.

7. A method according to claim 6 wherein said withdrawal device comprises a plug sized to provide a gas-tight fit within the neck opening of said dewar, and said withdrawal tube is secured to said plug with a gas-tight fit.

8. A device for withdrawing liquid cryogen from a dewar, consisting essentially of:

a plug sized to provide a tight fit within the neck opening of a liquid cryogen dewar; and a withdrawal tube passing through said plug and secured thereto with a gas-tight fit, said tube being of a length to reach substantially the bottom of a dewar with which said withdrawal device is to be used so as to receive liquid at a proximal end thereof, said tube extending outwardly from said plug so as to permit liquid to flow from a distal end thereof, said tube including a passive heat source near said proximal end.

9. A withdrawal device according to claim 8 including a gas pressure relief valve disposed in a hole through said plug so as to be in gaseous communication with the interior of said dewar when said withdrawal device is in use.

10. A withdrawal device according to claim 8 including a handle disposed on said plug to facilitate insertion of said withdrawal device into a dewar and removal of said withdrawal device from said dewar.

11. A withdrawal device according to claim 10 wherein said handle is formed of heat-insulating material.

12. A withdrawal device according to claim 8 including a sintered bronze filter disposed at the distal end of said withdrawal tube.

13. A withdrawal device according to claim 8 wherein said passive heat source has a heat capacity equivalent of between 25 grams of brass and 125 grams of brass.

14. A withdrawal device according to claim 13 wherein said passive heat source comprises brass weighing between 25 and 125 grams.

* * * * *